US005714704A

United States Patent [19]

Suzuki et al.

[11] Patent Number: 5,714,704

[45] Date of Patent: Feb. 3, 1998

[54] MUSICAL TONE-GENERATING METHOD AND APPARATUS AND WAVEFORM-STORING METHOD AND APPARATUS

[75] Inventors: Hideo Suzuki; Motoichi Tamura, both of Hamamatsu, Japan

[73] Assignee: Yamaha Corporation, Japan

[21] Appl. No.: 678,349

[22] Filed: Jul. 11, 1996

[30] Foreign Application Priority Data

Jul. 12, 1995 [JP] Japan ..... 7-197923

[51] Int. Cl.[6] ..... G10H 7/00

[52] U.S. Cl. ..... 84/604; 84/602; 84/627; 84/663

[58] Field of Search ..... 84/602–607, 627, 84/663

[56] References Cited

U.S. PATENT DOCUMENTS 5,194,681 3/1993 Kudo ..... 84/603
5,276,850 1/1994 Sakaue ..... 395/425
5,463,183 10/1995 Konno ..... 84/604

*Primary Examiner*—William M. Shoop, Jr.
*Assistant Examiner*—Marlon T. Fletcher
*Attorney, Agent, or Firm*—Graham & James LLP

[57] ABSTRACT

A method of generating musical tones is provided. Data indicative of waveforms including at least a first predetermined waveform and a second predetermined waveform are stored in a first storage device such as a RAM. Data indicative of the first predetermined waveform and the second predetermined waveform are sequentially read from the first storage device, in response to a tone-generating command. The data indicative of the first predetermined waveform is read from the first storage device and stored in a second storage device, such as a cache memory, which is operable at a higher speed than the first storage device. The data indicative of the first predetermined waveform stored in the second storage device is repeatedly read from the second storage device, following the reading of the data indicative of the first predetermined waveform from the first storage device. Musical tones are generated based on the data read out by the first and second reading steps. Typically, the first predetermined waveform and the second predetermined waveform are a loop waveform and an attack waveform, respectively.

14 Claims, 10 Drawing Sheets

| PROGRAM BLOCK | CACHE-OFF DATA BLOCK | CACHE-ON DATA BLOCK |
|---|---|---|

MUSICAL TONE-GENERATING METHOD AND APPARATUS AND WAVEFORM-STORING METHOD AND APPARATUS

BACKGROUND OF THE INVENTION

1. Field of the Invention

This invention relates to a musical tone-generating method and apparatus which reads waveform data from a memory and generates musical tones therefrom, and a waveform-storing method and apparatus which are suitable for use in implementing the musical tone-generating method.

2. Prior Art

A musical tone-generating method is conventionally known, which stores waveform data in a waveform memory, reads the waveform data from the waveform memory, and generates musical tones after subjecting the read waveform data to interpolation processing and/or other processing.

To apply the above conventional musical tone-generating method to a data processing apparatus such as a personal computer to generate musical tones by means of software, i.e. carry out tone generator processing, it is required to access the waveform memory for a large amount of waveform data stored in the waveform memory, in real time, necessitating high-speed memory access. Particularly, if the waveform memory is formed by a RAM, the use of a SRAM is required, which is high in access speed but expensive, leading to an increased cost.

On the other hand, conventionally known techniques for increasing the speed of access to a memory having a low access speed include one using a cache memory. This technique, however, uses a cache memory generally having a capacity of several kbytes to several tens of kbytes and therefore can shows useful results in frequently accessing a small memory area, but requires the use of a large-capacity cache memory to continuously access a memory area of several tens of kbytes to several hundreds of kbytes in order to read out waveform data in tone generator processing or the like. A simple application of the conventional technique, therefore, cannot contribute to an increased access speed.

SUMMARY OF THE INVENTION

It is a first object of the invention to provide a musical tone-generating method and apparatus and a waveform-storing method and apparatus which are capable of increasing the access speed by effective use of a small-capacity cache memory and thereby improving the processing capability of a tone generator without using any expensive SRAM or a like memory.

A second object of the invention is to provide a machine-readable storage medium for use in implementing the musical tone-generating method and apparatus and the waveform-storing method and apparatus in the preceding object.

To attain the first object, the present invention provides a method of generating musical tones, comprising a first storing step of storing in first storage means data indicative of waveforms including at least a first predetermined waveform and a second predetermined waveform, a first reading step of sequentially reading data indicative of the first predetermined waveform and the second predetermined waveform from the first storage means, in response to a tone-generating command, a second storing step of storing the data indicative of the first predetermined waveform read from the first storage means in second storage means operable at a higher speed than the first storage means, a second reading step of repeatedly reading the data indicative of the first predetermined waveform stored in the second storage means, following the reading of the data indicative of the first predetermined waveform by the first reading step, and a tone-generating step of generating musical tones based on the data read out by the first and second reading steps.

Typically, the first predetermined waveform and the second predetermined waveform are a loop waveform and an attack waveform, respectively.

Preferably, the first reading step includes accessing the second storage means for the data indicative of the first predetermined waveform when a musical tone is to be generated based on the data indicative of the first predetermined waveform, and reading the data indicative of the first predetermined waveform from the first storage means in an absence of the data indicative of the first predetermined waveform in the second storage means.

Also preferably, the method of generating musical tones further includes steps of storing as much sample data as required for interpolation of the data indicative of the first and second predetermined waveforms in third storage means, and replacing the sample data read out according to progression of a read address of the first storage means by oldest one of the sample data stored in the third storage means.

Preferably, the second storage means is a cache memory.

To attain the first object, the present invention further provides a method of storing waveforms, comprising a designation step of designating a specific block for storing data indicative of a first predetermined waveform in first storage means, the data being stored in second storage means operable at a higher speed than the first storage means after being read from the first storage means, the data being subsequently read from the second storage means by direct access, a first storing step of collectively storing a plurality of data indicative of a second predetermined waveform in a block other than the specific block of the first storage means, and a second storing step of collectively storing a plurality of the data indicative of the first predetermined waveform in the specific block of the first storage means.

To attain the first object, the present invention also provides an apparatus for generating musical tones, comprising first storage means for storing data indicative of waveforms including at least a first predetermined waveform and a second predetermined waveform, first reading means for sequentially reading data indicative of the first predetermined waveform and the second predetermined waveform from the first storage means, in response to a tone-generating command, second storage means for storing data indicative of the first predetermined waveform read out, the second storage means being operable at a higher speed than the first storage means, second reading means for repeatedly reading the data indicative of the first predetermined waveform stored in the second storage means, following the reading of the data indicative of the first predetermined waveform by the first reading means, and tone-generating means for generating musical tones based on the data read by the first and second reading means.

To attain the first object, the present invention further provides a waveform storage apparatus comprising a first storage block for collectively storing a plurality of data indicative of a first predetermined waveform, and a second storage block for collectively storing a plurality of data indicative of a second predetermined waveform, wherein the data indicative of the first predetermined waveform are stored in storage means operable at a higher speed than the waveform storage apparatus after being read from the first storage block, the data indicative of the first predetermined waveform being subsequently read from the storage means by direct access.

To attain the second object, the present invention provides a machine-readable storage medium containing instructions to cause a machine to perform method of generating musical tones, the method comprising a first storing step of storing in first storage means data indicative of waveforms including at least a first predetermined waveform and a second predetermined waveform, a first reading step of sequentially reading data indicative of the first predetermined waveform and the second predetermined waveform from the first storage means, in response to a tone-generating command, a second storing step of storing the data indicative of the first predetermined waveform read from the first storage means in second storage means operable at a higher speed than the first storage means, a second reading step of repeatedly reading the data indicative of the first predetermined waveform stored in the second storage means, following the reading of the data indicative of the first predetermined waveform by the first reading step, a tone-generating step of generating musical tones based on the data read out by the first and second reading steps.

To attain the second object, the present invention further provides a machine-readable storage medium containing instructions to cause a machine to perform method of storing waveforms, the method comprising a designation step of designating a specific block for storing data indicative of a first predetermined waveform in first storage means, the data being stored in second storage means operable at a higher speed than the first storage means after being read from the first storage means, the data being subsequently read from the second storage means by direct access, a first storing step of collectively storing a plurality of data indicative of a second predetermined waveform in a block other than the specific block of the first storage means;, and a second storing step of collectively storing a plurality of the data indicative of the first predetermined waveform in the specific block of the first storage means.

The above and other objects, features, and advantages of the invention will be more apparent from the following detailed description taken in conjunction with the accompanying drawings.

BRIEF DESCRIPTION OF THE DRAWINGS

FIGS. 7A to 7D are diagrams showing formats of various data stored in the RAM, in which:

FIG. 7A shows a format of tone color data;

FIG. 7B shows a format of event data stored in an input buffer;

FIG. 7C shows a format of data stored in an buffer or an output buffer; and

FIG. 7D shows a format of data stored in a tone generator register;

DETAILED DESCRIPTION

The invention will now be described in detail with reference to the drawings showing an embodiment thereof.

Figure 1:
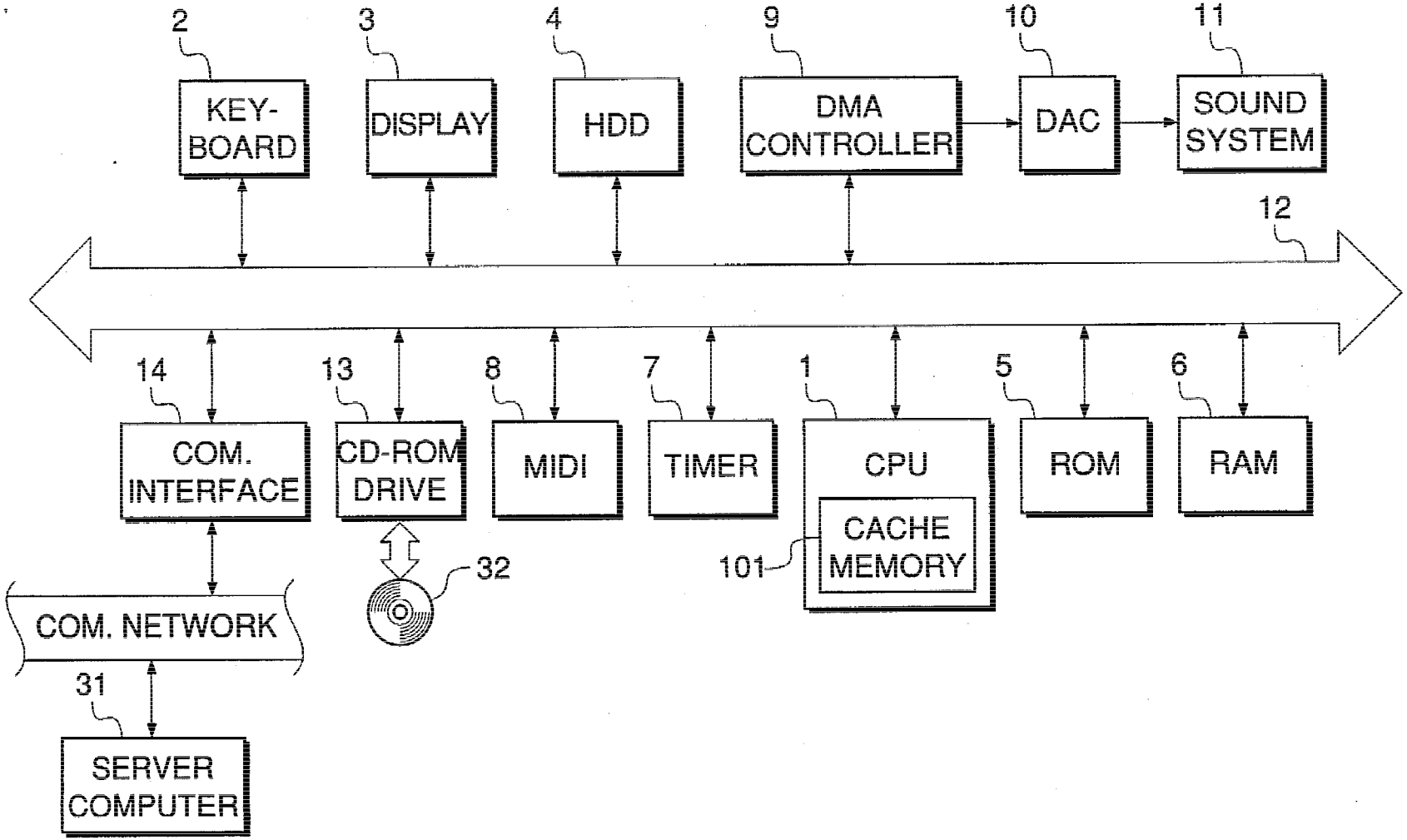
FIG. 1 is a block diagram showing the arrangement of a data processing system as an embodiment of the invention.

Referring first to FIG. 1, there is illustrated the arrangement of a data processing system according to an embodiment of the invention. This system includes a CPU 1 having a cache memory 101 and for performing various data processing, a keyboard 2 through which a user inputs program execution commands and data, a display unit 3 for displaying various image and character information, a hard disk drive (HDD) 4 storing data and programs executed by the CPU 1, a ROM 5 storing programs for controlling data inputting/outputting to and from the keyboard 1, the display unit 3 and the HDD 4, a RAM 6 for storing programs being executed, waveform data and data calculated, a timer 7, a MIDI interface 8 connected to a performance unit like a keyboard to be supplied with performance data therefrom, a DMA (direct memory access) controller 9 for directly accessing the RAM 6 to read musical tone-generating data (waveform data) therefrom and delivering the read data, sample by sample, to a D/A converter 10 in response to a command from the CPU 1, the D/A converter 10 converting the musical tone-generating data in the form of a digital signal supplied from the DMA controller 9 to an analog musical tone signal, a sound system 11 for amplifying and outputting the musical tone signal by way of a loudspeaker, and a bus 12 interconnecting the component elements 1 to 9.

The HDD 4 stores an operating program and various data including automatic performance data and code progression data. In the case where any operating program is not stored in the ROM 5, an operating program may be stored in a hard disk within the HDD 4. This operating program is read into the RAM 6 so that the CPU 1 operates on the operating program in the same way as if an operating program is stored in the ROM 5. By so doing, the addition of an operating program and new versions of the operating program are facilitated. A CD-ROM (compact disk read-only memory) drive 13 is also connected to the bus 12, which reads an operating program and various data stored in a CD-ROM set therein. The operating program and various data thus read out are stored in the hard disk within the HDD 4. It is thus easy to install a further operating program or a new version of the operating program. Devices for utilizing various types of media including a floppy disk drive and a magneto-optical (MO) disk drive may also be provided as external storage devices.

A communication interface 14 is also connected to the bus 12. The communication interface 14 is connected to a communication network 21 such as a LAN (local area network), an internet or a telephone line. The communication interface 14 is connected to a server computer 31 through the communication network 21. In the case where the operating program and various data are not stored in the HDD 4, the communication interface 14 is used to download programs and data from the server computer 31. The present data processing system constituting a client transmits a command requesting the server computer 31 to download an operating program and data through the communication interface 14 and the communication network 21. The server computer 31 receives this command and delivers the requested operating program and data to the data processing system through the communication network 21. The data processing system receives the program and data through the communication interface 14 and accumulates them in the HDD 4. The downloading is thus completed.

The present invention may alternatively be implemented by the use of a commercially available personal computer or the like with an operating program and data adapted to the invention installed therein. In such a case, a storage medium such as a CD-ROM or a floppy disk which stores the operating program and data adapted to the invention and can be read by a personal computer can be offered to the user. In the case where such a personal computer or the like is connected to a communication network like a LAN, an internet or a telephone line, the operating program and the data can be offered to the personal computer or the like through the communication network.

Now, musical tone-generating processing executed by the apparatus according to the invention will be described briefly with reference to FIGS. 2A, 2B and 2C.

Figures 2A, 2B, 2C:
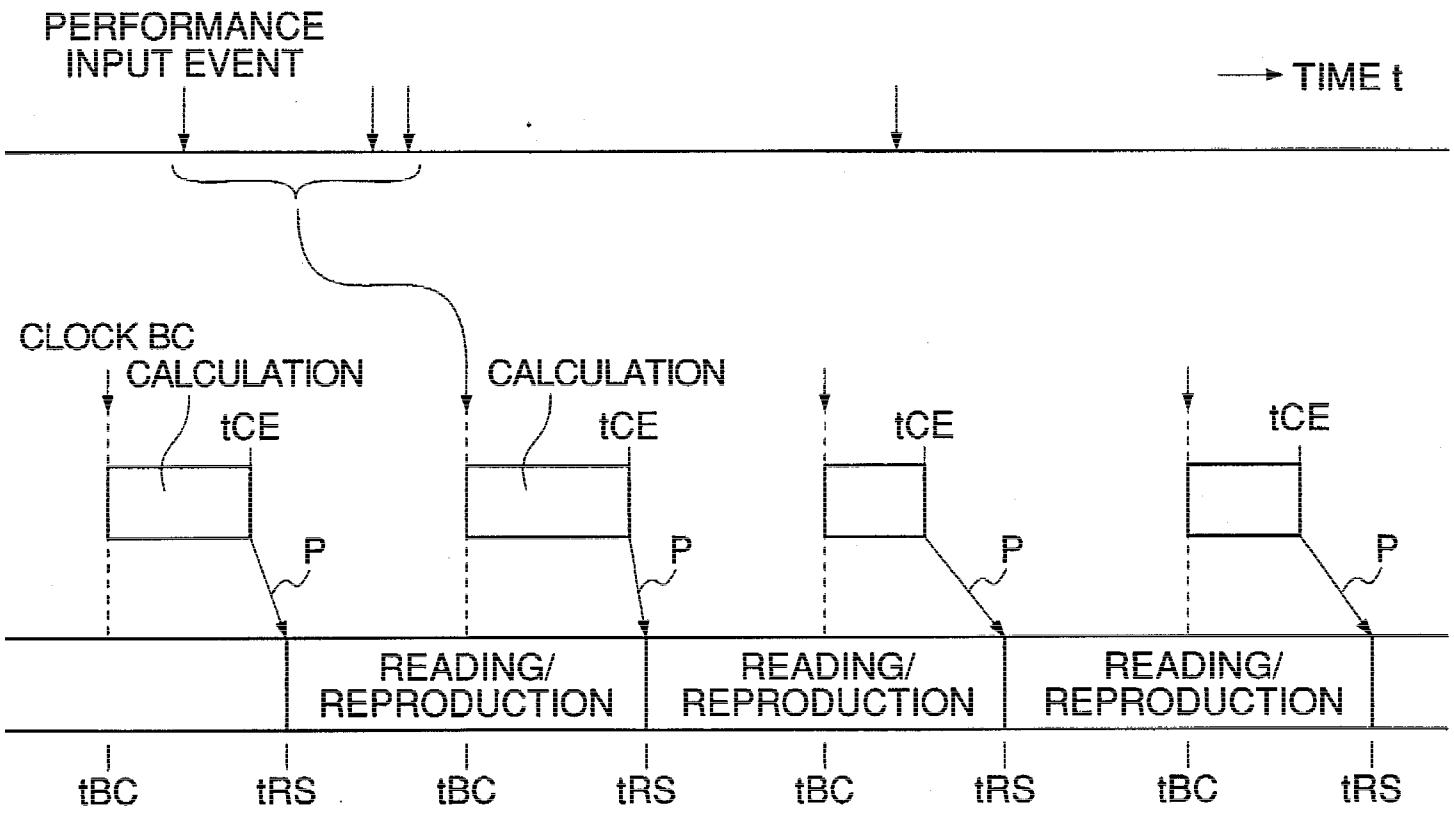
FIGS. 2A–2C are diagrams useful in explaining an outline of processing for generating musical tones by the system of FIG. 1.

In the present apparatus, the CPU 1 reads waveform data of 128 samples collectively in synchronism with a clock BC, executes calculations including interpolation to generate musical tones, stores the calculated data, i.e. tone-generating data (hereinafter referred to as "waveform data" unless otherwise specified) in the RAM 6, and notifies the DMA controller 9 of the completion of the calculations (FIG. 2B). The DMA controller 9 reads and reproduces the data (FIG. 2C). Performance data input through the MIDI interface 8 corresponding to a performance input event (FIG. 2A) occurring during the period from the immediately preceding occurrence time point tBC to the present occurrence time point tBC of the clock signal BC is subjected to the present calculation for generating a musical tone. Reading and reproducing of the data for generating a musical tone for which the calculation is completed at the following time point tCE is executed by the DMA controller 9 starting at a time point tRS upon the lapse of a predetermined time period after the present occurrence time point tBC. A musical tone is thus generated. Each of arrows P shown in FIG. 2 simply indicates the correspondence between the calculated musical tone-generating data and the reading-reproducing processing, but does not indicate that the result of the calculation completed at the time point tCE is transferred at the time point tRS.

According to the present embodiment, assuming that the sampling frequency is 44 KHz, for example, the clock BC is then generated at time intervals of 2.9 msec (128/44K). Hence, the delay time from a performance input event to actual generation of a musical tone is approximately 4 msec, which poses no listening problem to the human. For automatic performance, the delay time may be longer of course.

Figures 3, 4:
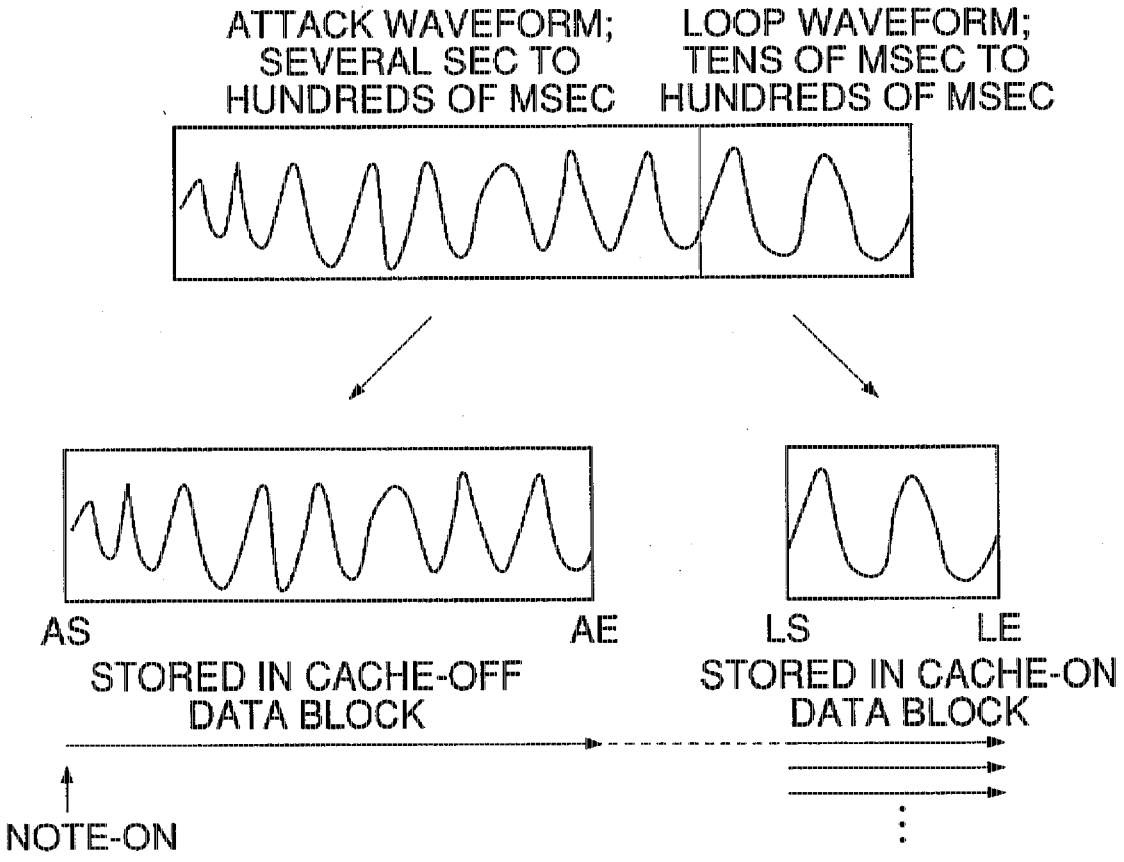
FIG. 3 is a diagram showing an address map of a RAM appearing in FIG. 1.
FIG. 4 is a diagram useful in explaining storage areas for attack section waveform data and loop section waveform data indicative of musical tones.

FIG. 3 shows an address map of the RAM 6. According to the present embodiment, the storage area of the RAM 6 is divided into a program block for storing programs, a cache-on data block for storing data which, once read out, are stored in the cache memory 101, and read from the cache memory 101 without accessing the RAM 6 as long as the data are stored in the cache memory 101 (hereinafter referred to as the "caching"), and a cache-off data block for storing data not to be cached. As shown in FIG. 4, attack section waveform data corresponding to attack waveforms are stored in the cache-off data block, and loop section waveform data corresponding to loop waveforms iteratively reproduced are stored in the cache-on data block. A plurality of attack section waveform data and a plurality of loop section waveform data are stored collectively in the cache-off data block and the cache-on data block, respectively. Characters AS and AE in FIG. 4 designate a start address and an end address, respectively, of the block where an attack section waveform data is stored. Characters LS and LE, on the other hand, designate a start address and an end address, respectively, of the block where a loop section waveform data is stored.

According to the present embodiment, the cache-on data block also stores tone color data, and is provided with a tone generator register, an x buffer, an output buffer and other work areas. The X buffer may alternatively be arranged in the cache-off data block.

The programs stored in the program block are cached using an instruction cache block other from a data cache block in the cache memory 101. The apparatus according to the present embodiment also has a multi-task function capable of executing other programs in parallel to the tone generator processing program. Therefore, other software programs and data are also stored in blocks of the RAM 6.

Figure 5:
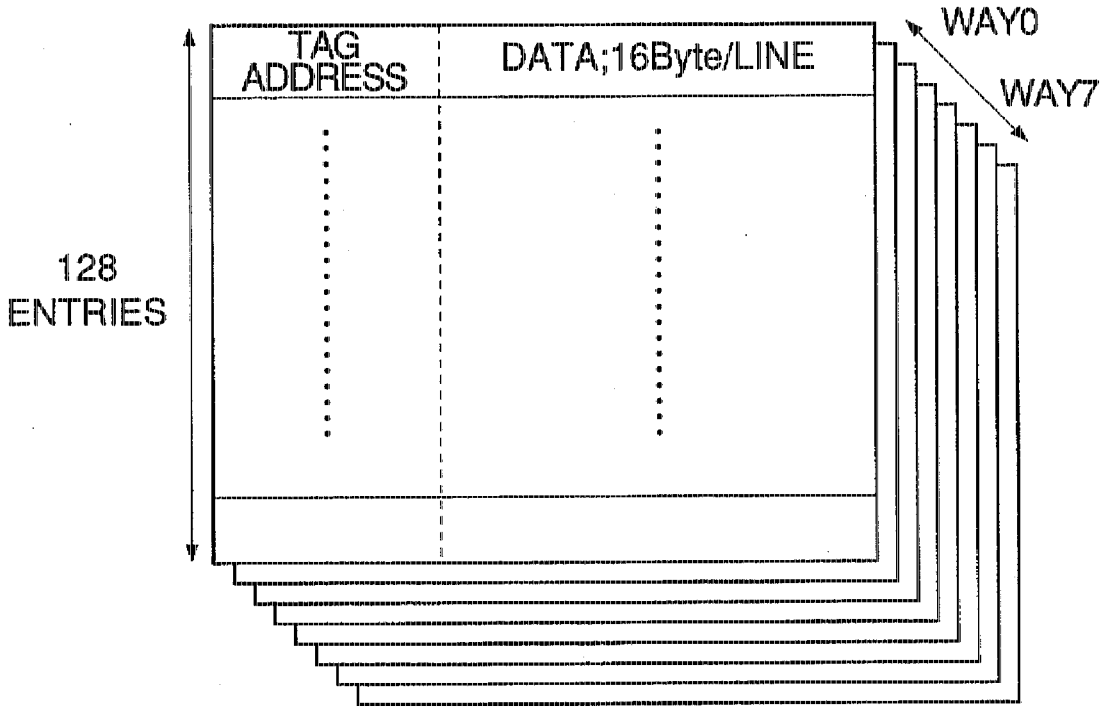
FIG. 5 is a diagram showing a configuration of a cache memory appearing in FIG. 1.

FIG. 5 shows a configuration of the data cache block of the cache memory 101. The cache memory 101 is comprised of eight ways (data storage blocks) 0 to 7. Each way has 128 entries, each of which is composed of 16 one-byte data (data of 16 bytes in total) and tag addresses indicating locations where these data are stored in the RAM 6. Each entry is thus composed of 16 bytes of data because the CPU 1 is adapted to read data from the RAM 6 in 16 bytes.

Figure 6:
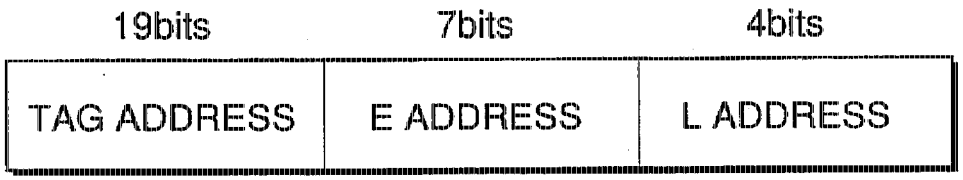
FIG. 6 is a diagram showing a configuration of RAM address data.

The address of the RAM 6 (RAM address) is comprised of a 19-bit tag address, a 7-bit entry address and a 4-bit line (L) address, as shown in FIG. 6. The entry address represents one of the 128 entries in FIG. 5. The line address is indicative of one of the 16 data in an entry. When the CPU 1 reads data, it first accesses the cache memory 101, sequentially from the way 0, for data for which a tag address of an entry indicated by the entry address coincides with a tag address in the RAM address. When the cache memory stores data for which the two kinds of addresses coincide with each other, the CPU 1 reads out the data from the cache memory. Otherwise, the CPU 1 reads out the data from the corresponding address of the RAM 6. When data stored in the cache-off data block are to be read out, however, the CPU 1 directly accesses the RAM 6 to read out the data without referring to the cache memory 101. By thus dividing the data storage area of the RAM 6 into the cache-off data block and the cache-on data block, when data stored in the cache-off data block are to be read out, the need of accessing the cache memory 101 is eliminated, thereby saving time and hence contributing to increase of the access speed.

According to the present embodiment, the capacity of the data cache block of the cache memory 101 is 16 kbytes (16 bytes×128 entries×8 ways). This size of capacity can secure as many as 32 tone generating channels.

FIGS. 7A to 7D show formats of tone color data stored in the RAM 6 and data stored in the input buffer, X buffer, output buffer and tone generator register provided on the RAM 6.

Figure 7A:
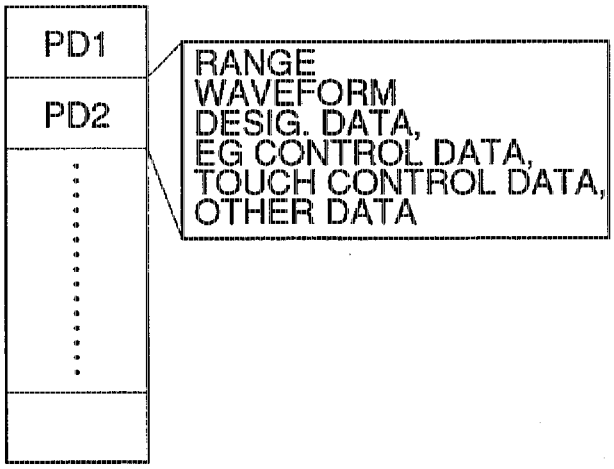
Figure 7B:
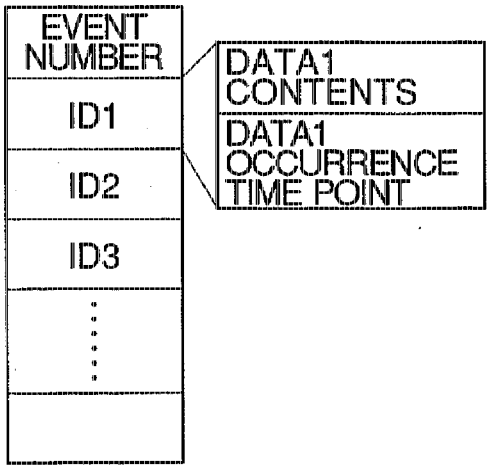

Referring first to FIG. 7A, tone color data PD1, PD2, and so on, stored in the RAM 6 are each comprised of data for designating a waveform of a range, envelope generation control data, touch control data and other data. The input buffer shown in FIG. 7B is for storing performance data input through the MIDI interface 8. This input buffer is comprised of a block for storing data indicative of the number of events, and blocks for storing event data ID1, ID2, ID3, and so on, corresponding respectively to the events. Each event data is comprised of data indicative of the event content, and data indicative of a time point of event occurrence. The data indicative of a time point of event occurrence is required for the CPU 1 to process a plurality of events collectively.

Figure 7C:
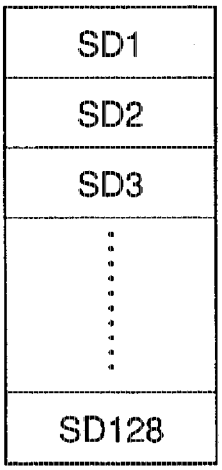

The X buffer and the output buffer shown in FIG. 7C have the same configuration. Specifically, waveform data of 128 samples constituting a unit of processing for the CPU 1 are stored as SD1, SD2, . . . , SD128. The CPU 1 subjects the waveform data to processings including tone color filtering and sound volume envelope processing by the use of the X buffer, and accumulates the data thus processed on the output buffer. The 128-sample waveform data in the output buffer 128 are collectively delivered to the DMA controller 9, which in turn delivers the data, sample by sample, to the DAC 10, thus accomplishing the reproduction operation.

Figure 7D:
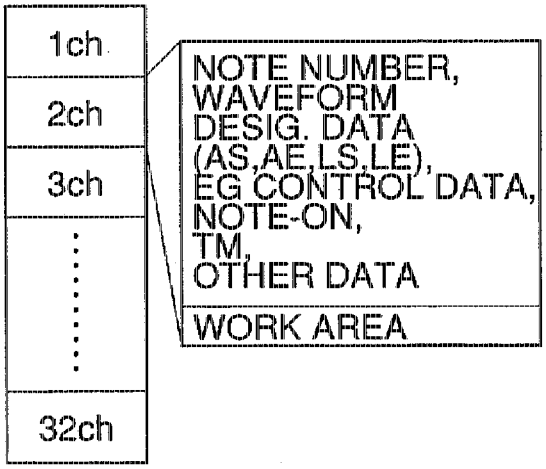

The tone generator register shown in FIG. 7D is for storing control data for each tone-generating channel. According to the present embodiment, the tone generator register is comprised of registers for 32 channels. The control data, which is prepared by processing tone color data based on performance data such as touch, is comprised of a note number, waveform-designating data (specifically, RAM addresses AS, AE, LS and LE in FIG. 4 of waveform data), envelope generation control data such as attack rate and attack level, note-on data indicating whether a musical tone is being generated or not, tone generation start timing data TM, and other data. The tone generator register further has provided therein a work area for tone generation processing. This work area has stored therein, for example, present values of address and envelope and past data of the same for filter calculation.

Now, calculations performed by the CPU 1 will be described in detail with reference to FIGS. 8 to 13.

Figure 8:
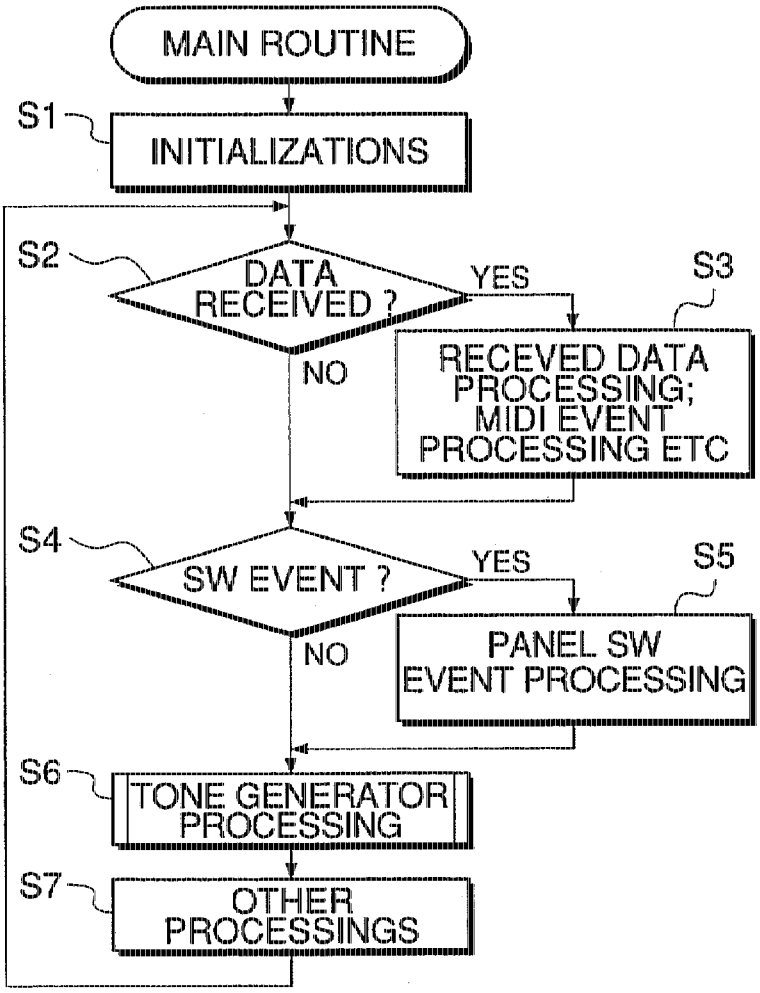
FIG. 8 is a flowchart showing a main routine executed by a CPU appearing in FIG. 1.
Figure 9:
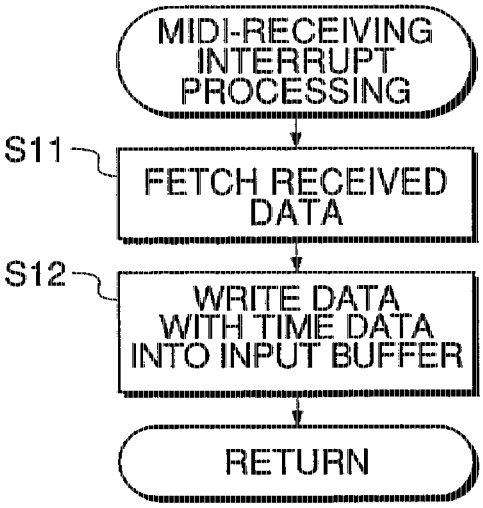
FIG. 9 is a flowchart showing MIDI-receiving interrupt processing.

FIG. 8 shows a main routine. With initiation of the tone generator processing program, the main routine is started. FIG. 9 shows MIDI-receiving interrupt processing. This interrupt processing is executed with the highest priority upon inputting of performance data through the MIDI interface 8.

First, the processing of FIG. 9 will be described. At a step S11, received data is fetched, and then at a step S12 the received data is written into the input buffer of the RAM 6 together with time data indicating when the data is received.

In the main routine of FIG. 8, first, initializations are executed to turn off all the tone-generating channels, and clear all the registers, etc. (step S1). Then, it is determined whether the input buffer contains received data or not (step S2). If no received data is contained, the program immediately proceeds to a step S4, whereas if the input buffer has received data, operations including note-on event processing, note-off event processing and pedal processing are performed, followed by the program proceeding to a step S4.

At the step S4, it is determined whether a switch event such as tone color selection has occurred. If no switch event has occurred, the program immediately proceeds to a step S6, whereas if a switch event has occurred, panel switch event processing is executed, e.g. by selecting a tone color for each MIDI channel according to setting of a tone color-selecting switch, and then the program proceeds to a step S6.

Figure 11:
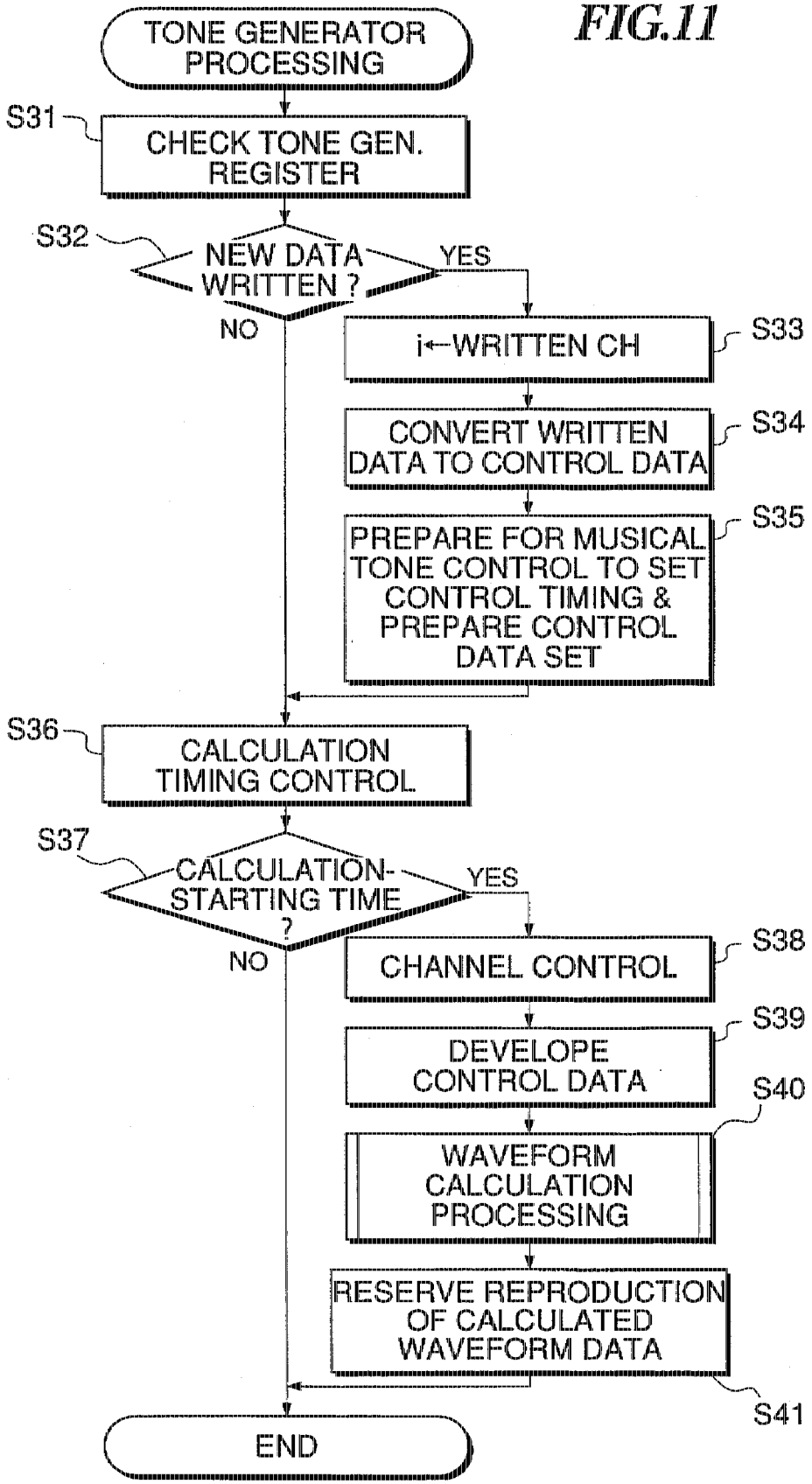
FIG. 11 is a flowchart showing details of tone generator processing in FIG. 8.

At the step S6, tone generator processing shown in FIG. 11 is executed, and further other processings are executed, followed by the program returning to the step S2. Thereafter, the steps S2 to S7 are repeatedly executed.

Figure 10:
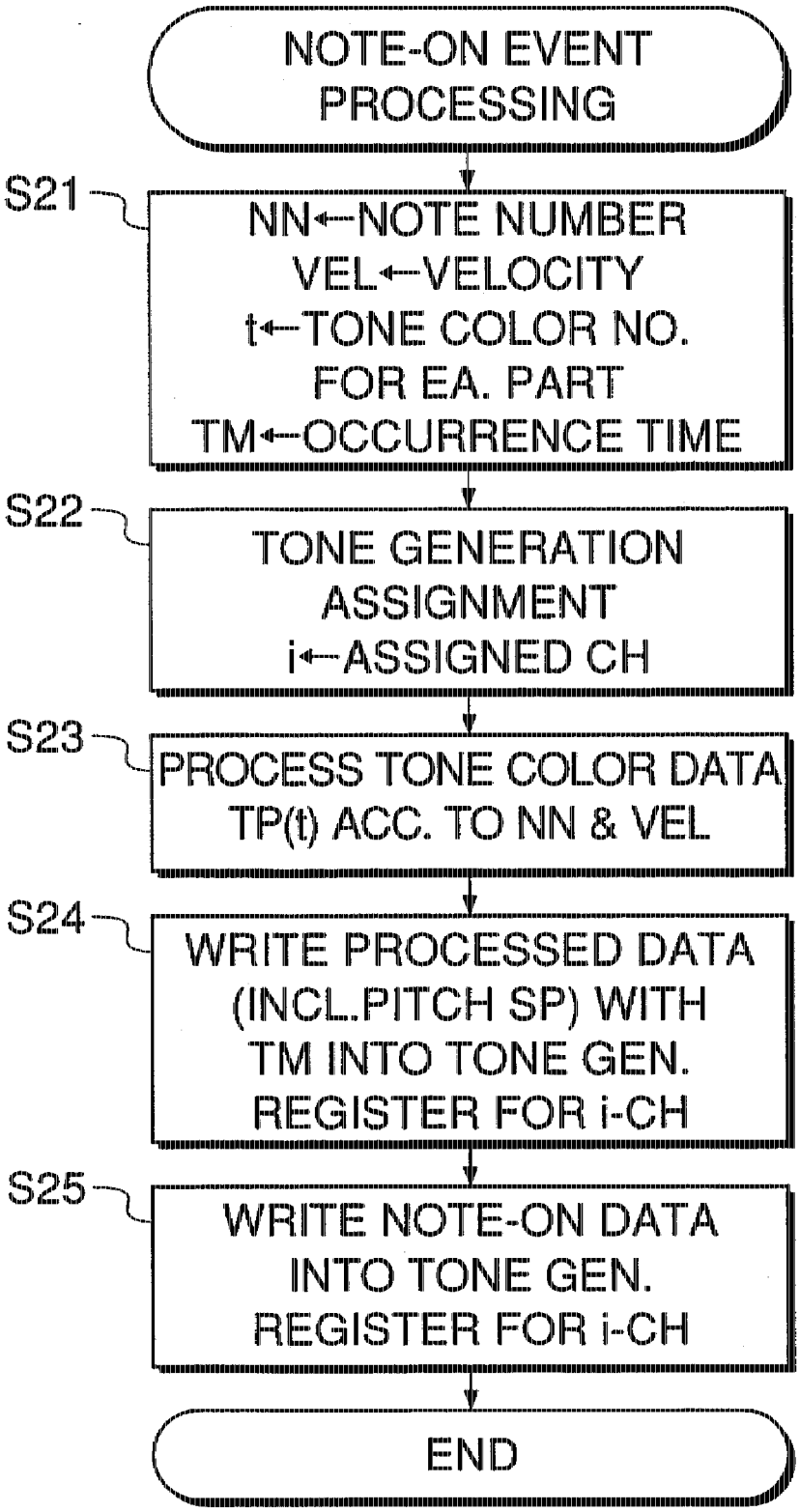
FIG. 10 is a flowchart showing note-on event processing executed when data is received through a MIDI interface appearing in FIG. 1.

FIG. 10 shows details of the note-on event processing which is one of the received data processings executed by the step S3 in FIG. 8.

First, at a step S21, the note number, velocity and tone number for each part in the received data are set as parameters NN, VEL and t, respectively, and at the same time the event occurrence time (receiving time) is set as a parameter TM. Then, a tone generation-assigning processing is performed for determining a tone-generating channel of the tone generator register (FIG. 7*d*) into which tone color data is to be written, and the assigned channel number is set as a parameter i (step S22). At the following step S23, tone color data TP(t) read from the RAM 6 according to the tone number t for each part is processed according to the note number N and velocity VEL. Further, the tone color data (including tone-generating pitch SP) thus processed is written into an i-channel tone generator register together with the event occurrence time TM (step S24). At the next step S25, note-on data is written into the i-channel tone generator register, thereby completing the processing.

When the CPU 1 reads data from the tone generator register, caching is carried out. In this processing, data for one channel is used for caching, which is of a size equivalent to an integer multiple of the amount of data for a line of the cache memory 101. The caching is thus carried out channel by channel. In this way, data for a channel into which data has been written, that is, a channel which is in the process of generating a musical tone, is selectively cached, thus improving the utilization rate of the cache memory 101.

FIG. 11 shows details of the tone generator processing executed at the step S6 in FIG. 8.

First, at a step S31, the tone generator register (FIG. 7D) is checked, followed by determining whether or not new data has been written into the tone generator register. If no data has been written, the program immediately proceeds to a step S36. If new data has been written, the number of the tone-generating channel into which new data has been written is set as a parameter i (step S33), and the data thus written is converted into control data for controlling waveform calculation (step S34). At the following step S35, preparations are made for tone generator control based on the converted data. More specifically, the present address value AD (i) for the i-channel at the time of note-on is set as the start address AS for the attack section waveform data, an attack flag AF is set to "1" to indicate that attack waveform data is being reproduced, or like preparations are made, thereby setting control timing and preparing a set of corresponding control data. After executing the step S35, the program proceeds to the step S36.

At the step S36, the calculation timing control is carried out. Specifically, a timing earlier by a predetermined time than the time reading of the musical tone-generating data currently under reproduction is completed is designated as a calculation-starting time point tBC (FIG. 2) in such a manner that waveform data to be reproduced are continuously read without interruption at a reproduction block (DMA controller 9). At the following step S37, it is determined whether or not the calculation-starting time point tBC has been reached, and if not, the program is immediately terminated.

When the calculation-starting time point has been reached, channel control is first carried out to determine a sequence of calculations and a channel to be stopped from generating a musical tone, according to musical tones to be produced by respective channels (step S38). The calculation sequence is determined by reason of the fact that calculations of higher degrees of importance have to be made earlier in case that calculations may not be completed by the time they should be completed (i.e. the calculations may be stopped). Then, the data prepared at the step S35 are developed on the time axis to prepare for waveform calculations (step S39). Then, at a step S40, waveform data are read from the RAM 6 on the basis of the data developed at the step S39, and waveform calculations are performed to calculate reproducing waveform data to be reproduced for one unit section (128 samples). Then, at a step S41, reproduction of the calculated waveform to be reproduced (stored in the output buffer of the RAM 6) is reserved with the reproduction block (DMA controller 9), followed by terminating the program (time point tCE in FIG. 2).

Figure 12:
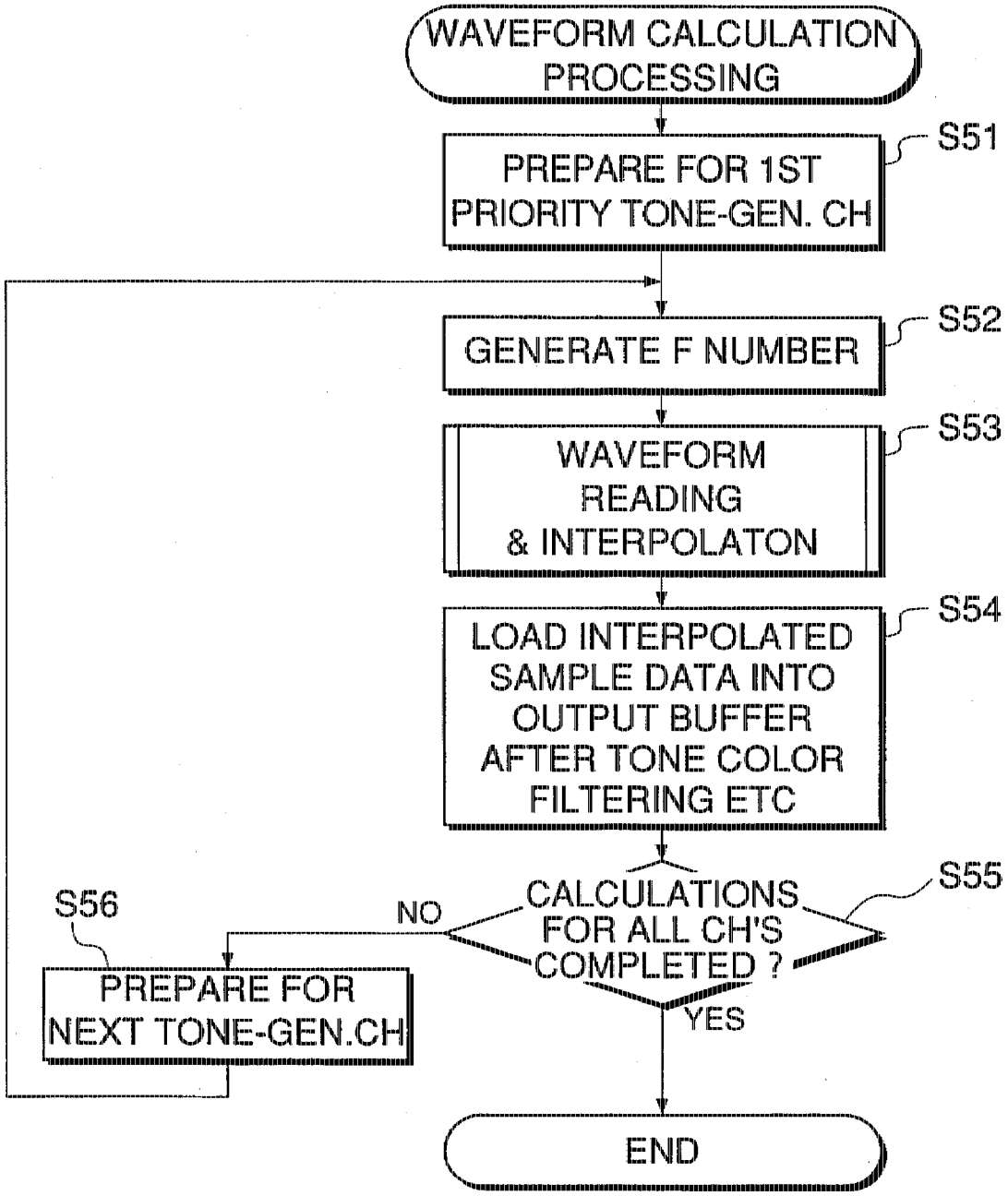
FIG. 12 is a flowchart showing details of waveform-calculating processing in FIG. 11.

FIG. 12 shows details of the waveform calculation processing executed at the step S40 in FIG. 11. First, at a step S51, preparations are made for calculation of data for a tone-generating channel with the first priority in calculation order. Then, an F number FN is generated according to the tone-generating pitch, time change or the like (step S52). The F number FN is a parameter indicative of the amount of address progression per sample, which will be used at the next step S53 for forming interpolated samples from waveform data (processing shown in FIG. 13 described later).

Then, at a step S53, waveform data is read from the RAM 6, and waveform-reading and interpolation processing is carried out to form interpolated sample data to the full capacity (i.e., 128 samples) of the X buffer which are formed of buffer areas associated with the respective samples. Then, the interpolated sample data are processed through tone color filtering and volume enveloping and other processings on the X buffer. The data thus processed are loaded into the output buffer (step S54). Then, at a step S55, it is determined whether calculations have been completed for all the channels for which data are to be calculated. If calculations have not yet been completed for all the channels, preparations are made for the calculation for the next tone-generating channel (step S56), and then the process returns to the step S52. Upon completion of calculations for all the channels for which data are to be calculated, the program is terminated. In the case where time expires for the calculations, however, the calculation is stopped, and then the program is forcibly terminated.

By the processing of FIG. 12, waveform data for the channels to be subjected to tone generation are accumulated in the output buffer, so that waveform data for 128 samples are prepared in the output buffer.

Figure 13:
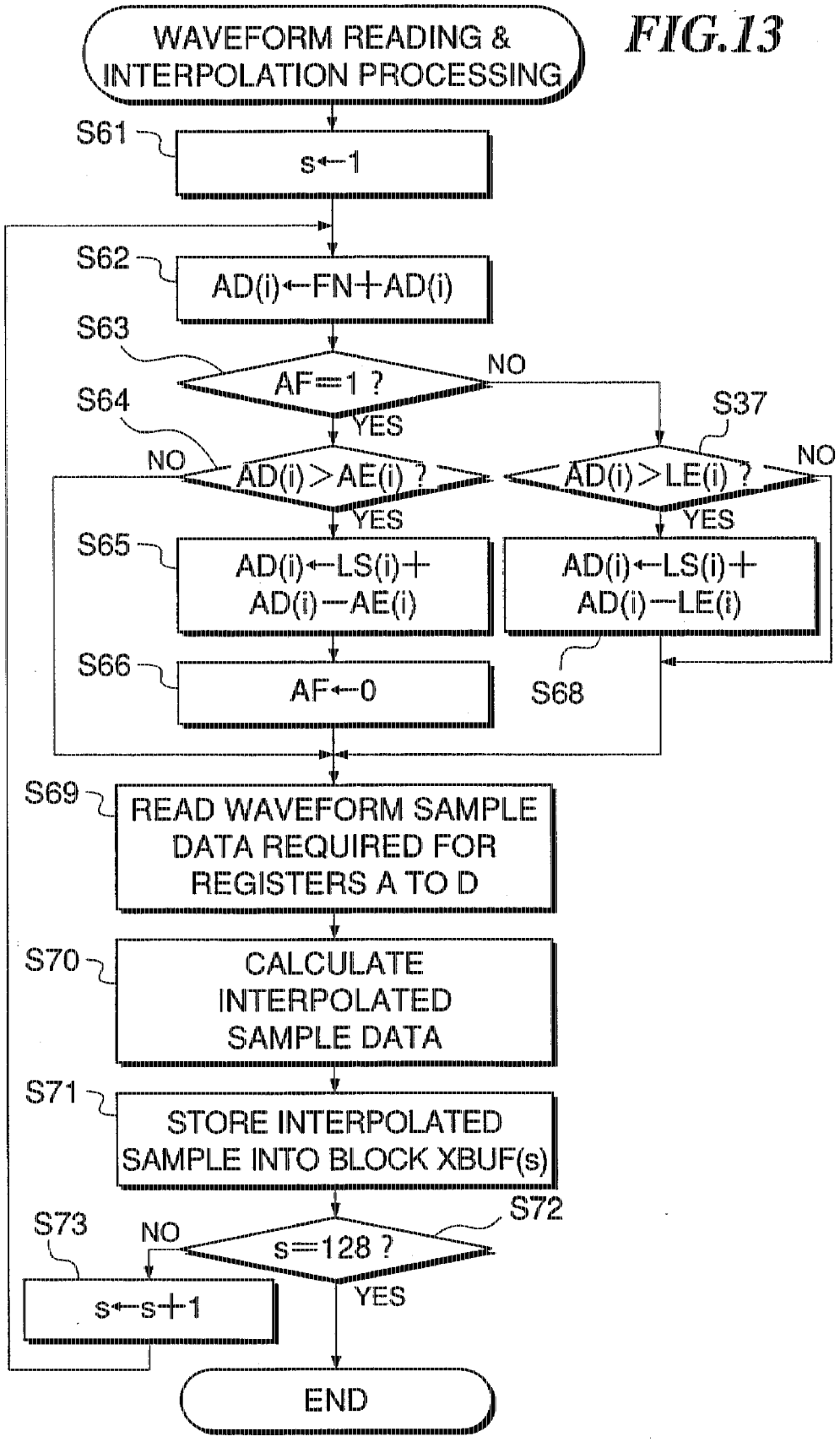
FIG. 13 is a flowchart showing details of waveform-reading and interpolation processing in FIG. 12.

FIG. 13 shows details of the waveform-reading and interpolation processing for preparing generating interpolated sample data up to the full capacity of the X buffer, executed at the step S53 in FIG. 12.

First, at a step S61, a parameter "s" indicating the order of a given sample is set to "1". Then, the F number FN is added to the present address value AD(i) for the i-channel to thereby update the address value (step S62). At the following step S63, it is determined whether or not the attack flag AF assumes "1". Initially, AF=1 holds, and therefore the program proceeds to a step S64 for determining whether the address value AD(i) has exceeded the end address AE(i) for the attack section waveform data.

Initially, AD(i)<AE(i) holds. The program therefore immediately proceeds to a step S69, wherein waveform sample data as many as required A, B, C and D for four registers in the CPU 1 are read out according to the integer part of the address value AD(i). If the integer part of the address value AD(i) is the start address AS(i) for the attack section waveform data, four waveform sample data are required to be read out in order to perform four-point interpolation, for example. This is also the case where the integer part of the address value AD(i) is the start address LS (i) for loop section waveform data. For other addresses, a sample or samples are read out by a number corresponding to an increment of the integer part due to updating of the address described above. For example, when the integer part is incremented by one, one sample is read out, and the oldest one of the data in the registers A to D is updated by the data thus read out. Next, at a step S70, interpolated sample data is calculated on the basis of the sample waveform data in the registers A to D and the decimal part of the address value AD(i). The calculated interpolated sample data is stored in a block (XBUF(s)) corresponding to the s-th sample of the X buffer (step S71). Then, at a step S72, it is determined whether or not the parameter s has reached 128. Since s=1 initially holds, the s value is incremented by "1" (step S73), and then the program returns to the step S62.

When AD(i)>AE(i) holds at the above-mentioned step S64, so that reading-out of the attack section waveform data is completed, the program is passed to a step S65 to update the address value AD(i) according to the equation shown below. As a result, smooth address connection is accomplished from attack section to loop section:

$$AD(i)=LS(i)+AD(i)-AE(i)$$

Then the attack flag AF is reset to "0" (step S66), followed by the program proceeding to a step S69.

When AF becomes zero, the program proceeds from the step S63 to a S67 to determine whether the address value AD(i) has exceeded the end address LE(i) for the loop section waveform data. Initially, AD(i)<LE(i) holds, and therefore the program immediately proceeds to the step S69. On this occasion, as described above, four sample data are read and stored in the registers A to D. In reading out loop section waveform data, however, the cache memory 101 is searched for corresponding data, and in the absence of such data, it is read from the RAM 6. The data, when read from the RAM 6, is stored in the cache memory 101. After that, the oldest data in the registers A to D is updated sample by sample. When AD(i) exceeds LE(i), the address value AD(i) is updated according to the following equation (step S68), followed by the program proceeding to the step S69:

$$AD(i)=LS(i)+AD(i)-LE(i)$$

As a result, the trailing end of the loop section can be smoothly address-connected to the leading end of the loop section.

As described above, caching is carried out in reading loop section waveform data, and the data, once read out from the RAM 6, are repetitively read from the cache memory 101. Thus, the access speed can be enhanced.

Also, since the sample data read in the past and required for the interpolation calculation at each time point are held in the registers A to D in the CPU 1, each sample data is read only once but not more than once. As a consequence, the processing speed is improved.

Although the above described embodiment uses a cache memory built in the CPU, the invention is not limited to such a configuration, but may employ a cache memory (secondary cache memory) arranged externally of the CPU.

According to the embodiment described above, a plurality of (four) CPU registers as many as the samples required for interpolation of waveform data are provided, so that the frequency of access to the memory (including the cache memory) is minimized. This method is effective especially for reading out attack section waveform for which the caching cannot be used. For the operation of reading out loop section for which the caching can be used, on the other hand, the method mentioned above is not always necessary. Nevertheless, this method is meaningful in consideration of the possible case where the use of a cache memory may be contested for even with respect to the loop section due to some factors leading to a lower cache hit ratio.

Also, in order to secure the efficiency of reading waveform data or loop section data start of reading, the addresses AS and LS should desirably be set in such a manner that the samples read for interpolation at the addresses AS and LS are each included in the 16-byte data of an entry.

According to the present invention, the loop section is cached. The caching may alternatively be used in the case where it is known in advance that a plurality of waveforms are required to be read out at a time during performance of a music piece such as automatic performance. In such a case, waveform to be read at that time are predicted, e.g. by reading out the waveform in advance, and stored in the cache memory.

Also, the tone generator processing program executed at the step S6 according to the embodiment has a very high probability of repetitive execution. In using the instruction cache block, therefore, the priority order of the caching during the processing should desirably be set higher than those of other programs of the embodiment. Further, the probability of repetition of the step S6 is high as compared with general application programs executed by the computer.

To cache the tone generator register blocks and work blocks for tone-generating channels, if the boundaries between the blocks for each channel are made to coincide with those between the 16-byte data of the entries, efficient caching is made possible. The data of each entry is not limited to 16-byte data, but it may be other byte data such as 32-byte and 64-byte data. In such a case as well, a similar coincidence to the above may apply.

Furthermore, according to the above described embodiment, a plurality of loop section waveform data are collectively stored in the cache-on data block. Preferably, these data are stored in such an arrangement that the entry addresses of blocks for storing frequently-used loop section waveform data are not overlapped. The frequently-used waveforms mean those used for particular parts in which more notes are performed than the other parts in the case where plural tone color parts are performed simultaneously. In other words, each of waveforms having respective tone colors has a range where its tone color is most frequently used, and the frequently used waveform means a waveform corresponding to the range.

Further, according to the present embodiment, a musical tone waveform is generated in a predetermined number of samples every calculation time of a predetermined period. The invention is not limited to this method of musical tone generation. Instead, a sample of waveform data may be generated every sampling period of the D/A converter 10, or as many waveform samples as required at the present time point may be generated by an irregular trigger operation.

In addition, according to the present embodiment, the invention is realized as software executed by a CPU. The invention is not limited to such a method, but may generally be realized using a calculation device such as a DSP (digital signal processor) which operates on a program.

What is claimed is:

1. A method of generating musical tones, comprising:

a first storing step of storing in first storage means data indicative of waveforms including at least an attack section waveform and a loop section waveform;

a first reading step of sequentially reading data indicative of said attack section waveform and said loop section waveform from said first storage means, in response to a tone-generating command;

a second storing step of storing said data indicative of said loop section waveform read from said first storage means by said first reading step in second storage means operable at a higher speed than said first storage means;

a second reading step of repeatedly reading said data indicative of said loop section waveform stored in said second storage means, following said reading of said data indicative of said loop section waveform by said first reading step; and a tone-generating step of generating musical tones based on said data read out by said first and second reading steps.

2. A method as claimed in claim 1, wherein said first reading step includes accessing said second storage means for said data indicative of said loop section waveform when a musical tone is to be generated based on said data indicative of said loop section waveform, and reading said data indicative of said loop section waveform from said first storage means in an absence of said data indicative of said loop section waveform in said second storage means.

3. A method as claimed in claim 1, further including steps of storing as many sample data as required for interpolation of said data indicative of said attack section and loop section waveforms in third storage means, and replacing said sample data read out according to progression of a read address of said first storage means by oldest one of said sample data stored in said third storage means.

4. A method as claimed in claim 1, wherein said second storage means is a cache memory.

5. A method of storing waveforms, comprising:

a designation step of designating a specific block for storing data indicative of a loop section waveform in first storage means, said data being stored in second storage means operable at a higher speed than said first storage means after being read from said first storage means, said data being subsequently read from said second storage means by direct access;

a first storing step of collectively storing a plurality of data indicative of an attack section waveform in a block other than said specific block of said first storage means; and a second storing step of collectively storing a plurality of said data indicative of said loop section waveform in said specific block of said first storage means.

6. A method as claimed in claim 5, wherein said second storage means is a cache memory.

7. An apparatus for generating musical tones, comprising:

first storage means for storing data indicative of waveforms including at least an attack section waveform and a loop section waveform;

first reading means for sequentially reading data indicative of said attack section waveform and said loop section waveform from said first storage means, in response to a tone-generating command;

second storage means for storing data indicative of said loop section waveform read out by said first reading means, said second storage means being operable at a higher speed than said first storage means;

second reading means for repeatedly reading said data indicative of said loop section waveform stored in said second storage means, following said reading of said data indicative of said loop section waveform by said first reading means; and tone-generating means for generating musical tones based on said data read by said first and second reading means.

8. An apparatus as claimed in claim 7, wherein said first reading means accesses said second storage means for said data indicative of said loop section waveform when a musical tone is to be generated based on said data indicative of said loop section waveform, said first reading means reading said data indicative of said loop section waveform from said first storage means in an absence of said data indicative of said loop section waveform in said second storage means.

9. An apparatus as claimed in claim 7, further including third storage means for storing as many sample data as required for interpolation of said data indicative of said attack section and loop section waveforms, and control means for replacing said sample data read out according to progression of a read address of said first storage means by oldest one of sample data stored in said third storage means.

10. An apparatus as claimed in claim 7, wherein said second storage means is a cache memory.

11. A waveform storage apparatus comprising:

a first storage block for collectively storing a plurality of data indicative of a loop section waveform; and a second storage block for collectively storing a plurality of data indicative of an attack section waveform;

wherein said data indicative of said loop section waveform are stored in storage means operable at a higher speed than said waveform storage apparatus after being read from said first storage block, said data indicative of said loop section waveform being subsequently read from said storage means by direct access.

12. An apparatus as claimed in claim 11, wherein said storage means is a cache memory.

13. A machine-readable storage medium containing instructions to cause a machine to perform a method of generating musical tones, said method comprising:

a first storing step of storing in first storage means data indicative of waveforms including at least an attack section waveform and a loop section waveform;

a first reading step of sequentially reading data indicative of said attack section waveform and said loop section waveform from said first storage means, in response to a tone-generating command;

a second storing step of storing said data indicative of said loop section waveform read from said first storage means by said first reading step in second storage means operable at a higher speed than said first storage means;

a second reading step of repeatedly reading said data indicative of said loop section waveform stored in said second storage means, following said reading of said data indicative of said loop section waveform by said first reading step; and a tone-generating step of generating musical tones based on said data read out by said first and second reading steps.

14. A machine-readable storage medium containing instructions to cause a machine to perform a method of storing waveforms, said method comprising:

a designation step of designating a specific block for storing data indicative of a loop section waveform in first storage means, said data being stored in second storage means operable at a higher speed than said first storage means after being read from said first storage means, said data being subsequently read from said second storage means by direct access;

a first storing step of collectively storing a plurality of data indicative of an attack section waveform in a block other than said specific block of said first storage means; and a second storing step of collectively storing a plurality of said data indicative of said loop section waveform in said specific block of said first storage means.

* * * * *